US005429313A

United States Patent [19]

Schwelling

[11] Patent Number: 5,429,313

[45] Date of Patent: Jul. 4, 1995

[54] PAPER SHREDDER WITH LOWER CABINET AND UPPER HOOD

[76] Inventor: Hermann Schwelling, Hartmannweg 5, D-88682 Salem, Germany

[21] Appl. No.: 214,606

[22] Filed: Mar. 18, 1994

[30] Foreign Application Priority Data

Mar. 22, 1993 [DE] Germany ..... 43 09 102.4

[51] Int. Cl.[6] ..... B02C 18/40; B02C 23/02

[52] U.S. Cl. ..... 241/36; 241/100; 241/236

[58] Field of Search ..... 241/36, 100, 236

[56] References Cited

U.S. PATENT DOCUMENTS

| | | | |
|---|---|---|---|
| 4,815,669 | 3/1989 | Fujii | 241/34 |
| 4,890,797 | 1/1990 | Fujii et al. | 241/34 |
| 4,964,579 | 10/1990 | Strohmeyer | 241/100 |
| 5,020,733 | 6/1991 | Strohmeyer | 241/100 |
| 5,188,301 | 2/1993 | Hasegawa | 241/33 |
| 5,295,633 | 3/1994 | Kimbro et al. | 241/166 |
| 5,362,002 | 11/1994 | Tsai | 241/222 |

*Primary Examiner*—John Husar
*Attorney, Agent, or Firm*—Friedrich Kueffner

[57] ABSTRACT

A paper shredder includes a lower cabinet and an upper hood for covering the cutting rollers, The hood has a supply duct for material to be cut which conically narrows toward the cutting roller intake gap, The supply duct has an inlet opening whose upper edge in vertical projection is located laterally offset relative to the cutting roller intake gap, The supply duct for the material to be cut has a funnel-shaped cross section and a bottom side of the supply duct extends initially approximately horizontally and is then arc shaped and leads into the essentially vertically directed cutting roller inatke gap. A duct wall extending from an upper side of the hood and forming the upper edge of the inlet opening of the supply duct is formed by a ledge member which is a separate component,

14 Claims, 5 Drawing Sheets

PAPER SHREDDER WITH LOWER CABINET AND UPPER HOOD

BACKGROUND OF THE INVENTION

1. Field of the Invention

The present invention relates to a paper shredder with a lower cabinet and an upper hood for covering the cutting rollers. The hood has a supply duct for material to be cut which conically narrows toward the cutting roller intake gap. The supply duct has an inlet opening whose upper edge in vertical projection is located laterally offset relative to the cutting roller intake gap.

2. Description of the Related Art

A paper shredder of the above-described type is known, for example, from GB-A-2 169 524. However, since this known paper shredder has an upwardly open funnel-shaped intake chute, it provides little protection to the operator against accidents due to loose articles of clothing entering the chute and it also provides no protection against harmful noise and dust emerging from the cutting mechanism gap.

SUMMARY OF THE INVENTION

Therefore, it is the primary object of the present invention to provide a paper shredder of the above-described type which has a specific configuration of the upper side of the upper portion of the housing in order to provide in a common unit several essential operating functions which had previously been missing in such paper shredders.

Specifically, the operator of the paper shredder is to be protected against endangerment, injuries and damage which could result from unintentional entering of loosely cut articles of clothing, particularly the arms, of ties or scarves or necklaces, etc. into the cutting roller intake gap. In addition, the operator and others are to be protected against dust and cutting noises emanating from the cutting mechanism through the supply duct for the material to be cut. Particularly in larger paper shredders, the free upper surface thereof should be usable for depositing material to be cut and simultaneously for ensuring a problem-free centered intake into the supply duct when shredding continuous paper sizes.

In accordance with the present invention, the supply duct for the material to be cut has a funnel-shaped cross section and a bottom side of the supply duct extends initially approximately horizontally and is then arc shaped and leads into the essentially vertically directed cutting roller intake gap. A duct wall extending from an upper side of the hood and forming the upper edge of the inlet opening of the supply duct is formed by a ledge member which is a separate component.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF TEE PREFERRED EMBODIMENTS

Figure 1:
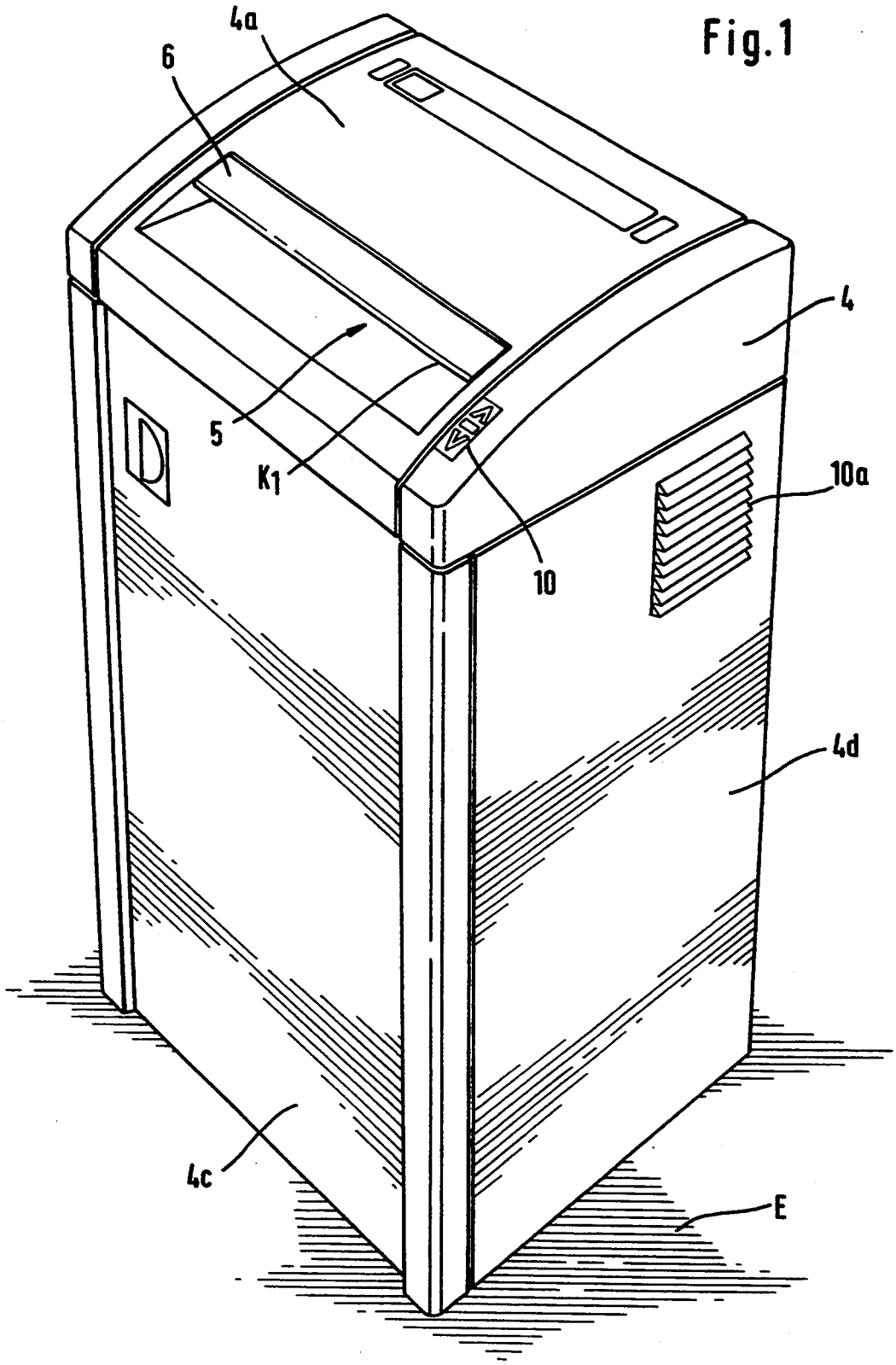
FIG. 1 is a perspective view showing the basic construction of the paper shredder according to the present invention.
Figure 2:
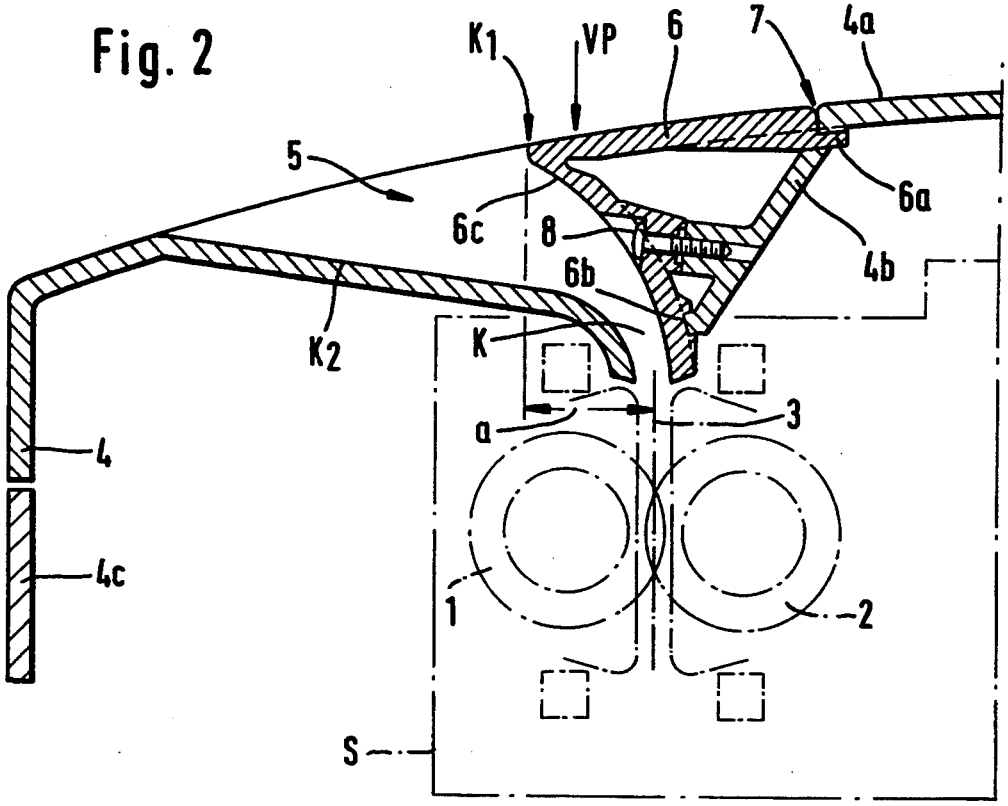
FIG. 2 is a sectional view, on a larger scale, showing the essential components of the paper shredder.

FIGS. 1 and 2 of the drawing show a basic embodiment of the paper shredder according to the present invention with a lower cabinet 4*c*, 4*d* and an upper hood 4 covering the cutting rollers 1, 2. The hood 4 includes a supply duct K for material to be cut which narrows conically toward the cutting roller intake gap 3. The supply duct K has an opening 5 whose upper edge $K_1$ in the vertical projection VP is laterally offset by a distance a relative to the cutting roller intake gap 3. As a result, the bottom side of the supply duct K overlaps or covers the intake gap 3.

The supply duct K, which is funnel-shaped in cross section, has a bottom side $K_2$ extending from the supply opening 5 initially approximately horizontally and subsequently extends along an arc to the essentially vertically directed cutting roller intake gap 3. A duct wall 6*a* extending from the upper side 4*a* of the hood 4 and including the upper edge $K_1$ is formed by a ledge member 6 which is a separate component.

In accordance with a further development of the invention, the ledge member 6 is a replaceable component which can be inserted and secured in a corresponding recess 7 of the hood 4. For this purpose, the ledge member 6 has elements 6*a* and 6*b* for inserting or clipping the ledge member 6 into the hood 4. All sides of the ledge member 6 extend flush with the upper side 4*a* of the hood 4. However, additional screws 8 for securely connecting the ledge member 6 to a corresponding flange 4*b* or the like in the interior of the hood 4 are also possible.

FIGS. 4–7 of the drawing show an embodiment of the paper shredder according to the present invention which provides a free upper surface particularly for larger paper shredders for placing material to be cut thereon.

Figure 4:
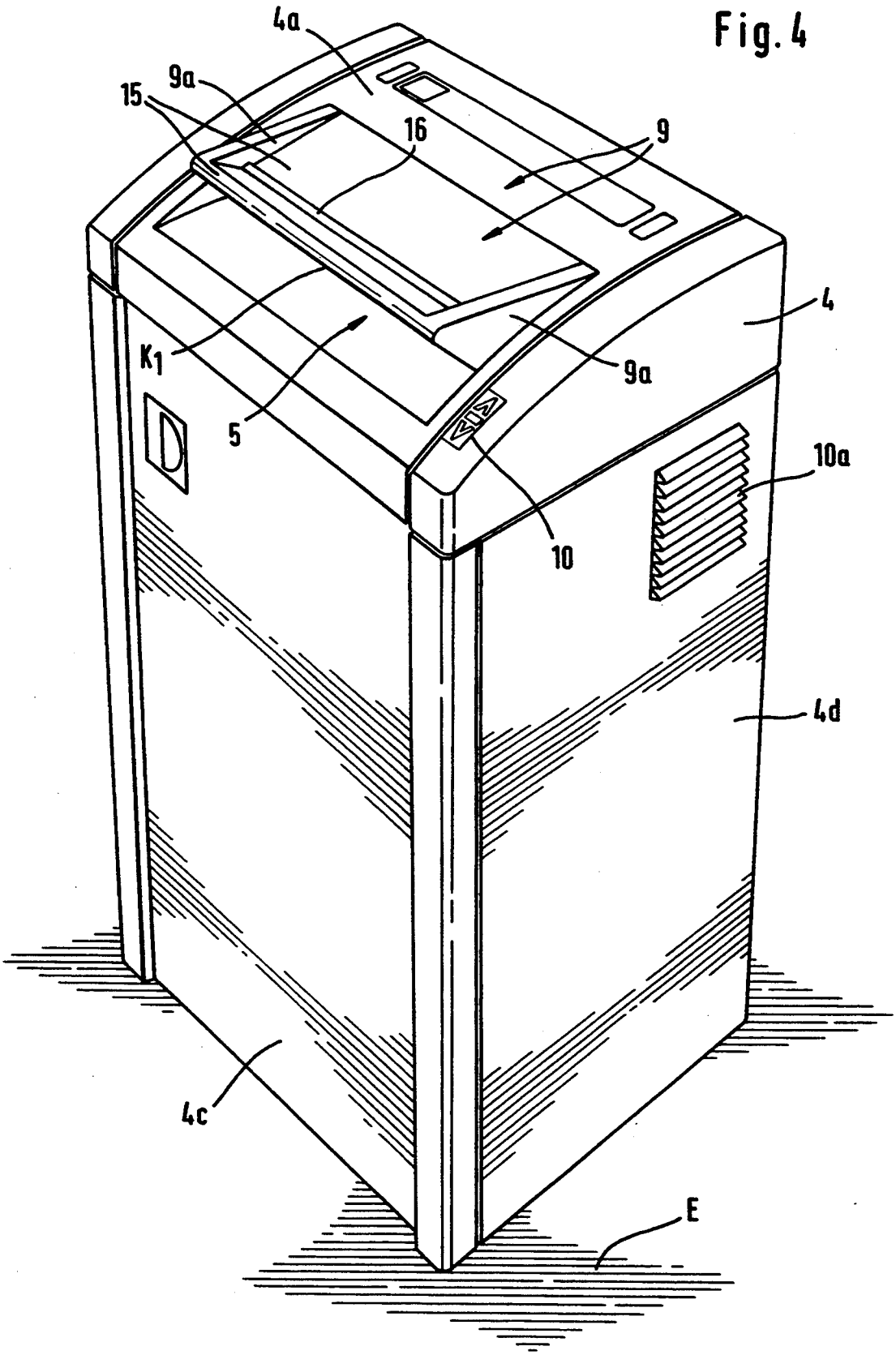
FIG. 4 is a perspective view of another embodiment of the paper shredder.

As shown in FIG. 4, the opening 5 of the supply duct K is arranged near the front side 4*c* of the hood 4 and the remaining free surface area 4a is essentially plane forming an area 9 for depositing, for example, so-called continuous paper sizes. Another important feature of this embodiment is the fact that the surface area 4*a* or 9 is inclined toward the opening 5, the front portion 15*b* of the ledge member 15 has extending upwardly from the free surface area 4*a* an angle portion 15*b* and a stop 16 is provided for a paper stack ST at the lowermost point of the angle portion 15*b*.

In accordance with another feature important for the operation of the paper shredder, the angled ledge member 15 has guide surfaces 9*a* arranged laterally of the paper stack ST, wherein the guide surfaces 9*a* extend from the surface contour 4*a* to the front edge $K_1$ of the duct wall 15*a*.

Figure 5:
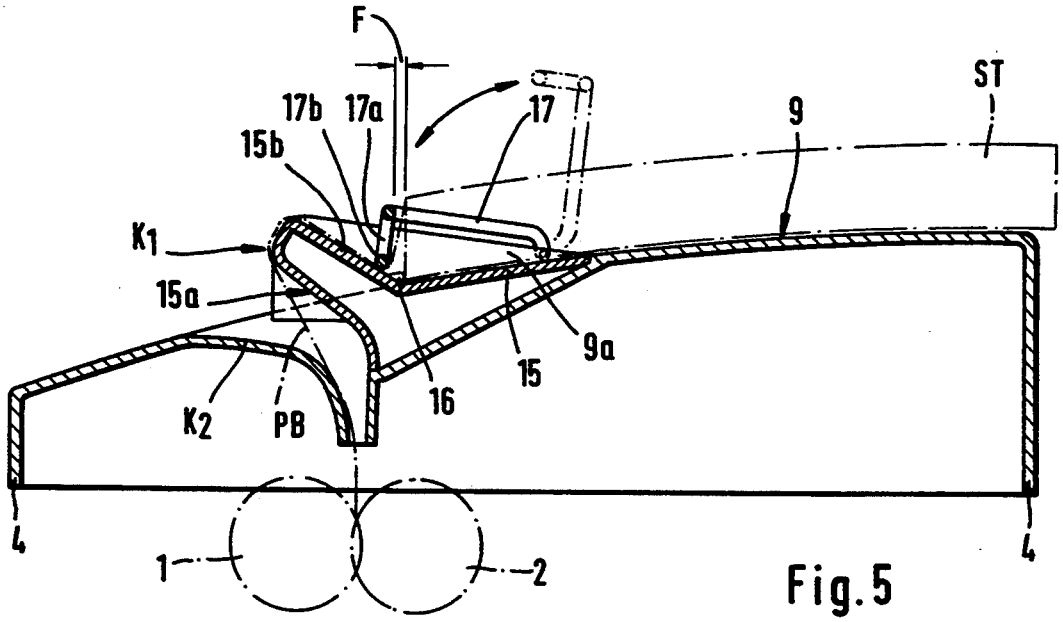
FIG. 5 is a sectional view, taken along sectional line A—A of FIG. 7, showing the essential components of the paper shredder of FIG. 4.

As shown in FIG. 5, the removal of folded continuous paper sizes from a stack ST and the problem-free automatic insertion of the paper sizes are ensured by a stirrup-shaped paper holding-down device 17. The holding-down device 17 has free ends 17*b* and the holding-down device 17 is essentially vertically pivotably mounted with its free ends 17*b* in the lateral guide surfaces 9*a*.

Figure 6:
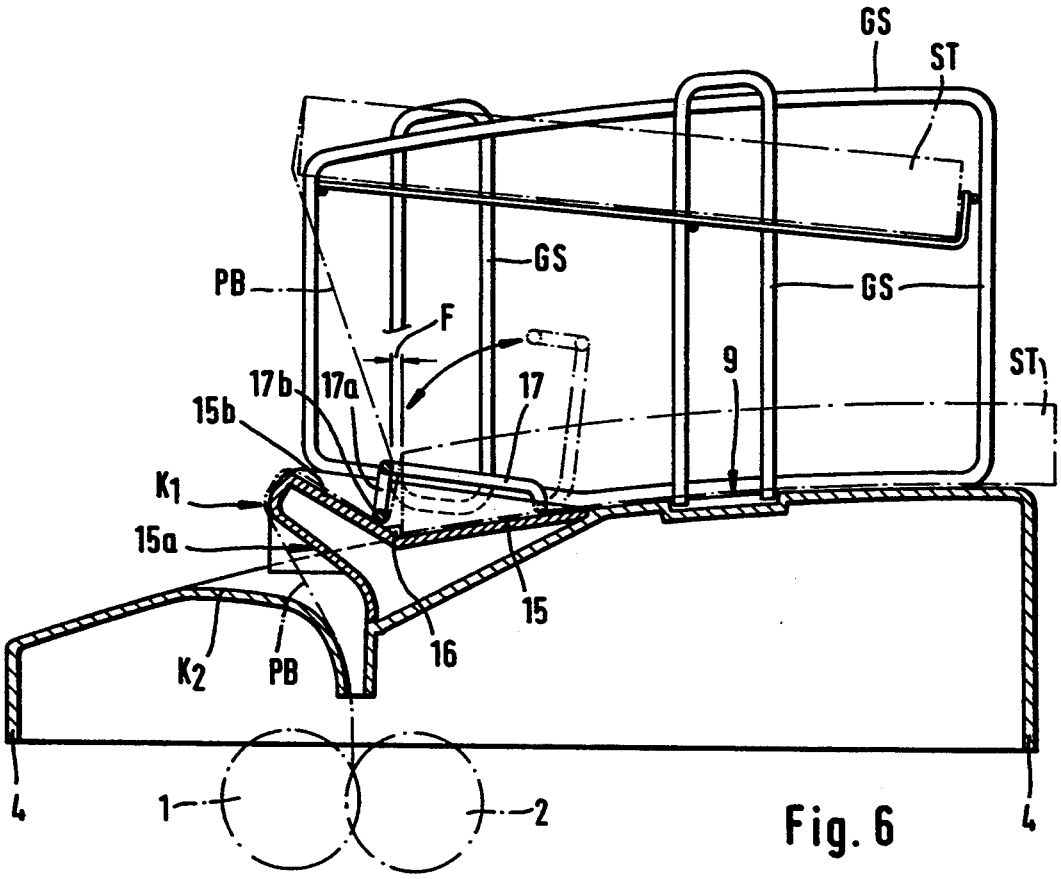
FIG. 6 is a sectional view, similar to FIG. 5 showing the essential components of a further development of the paper shredder.
Figure 7:
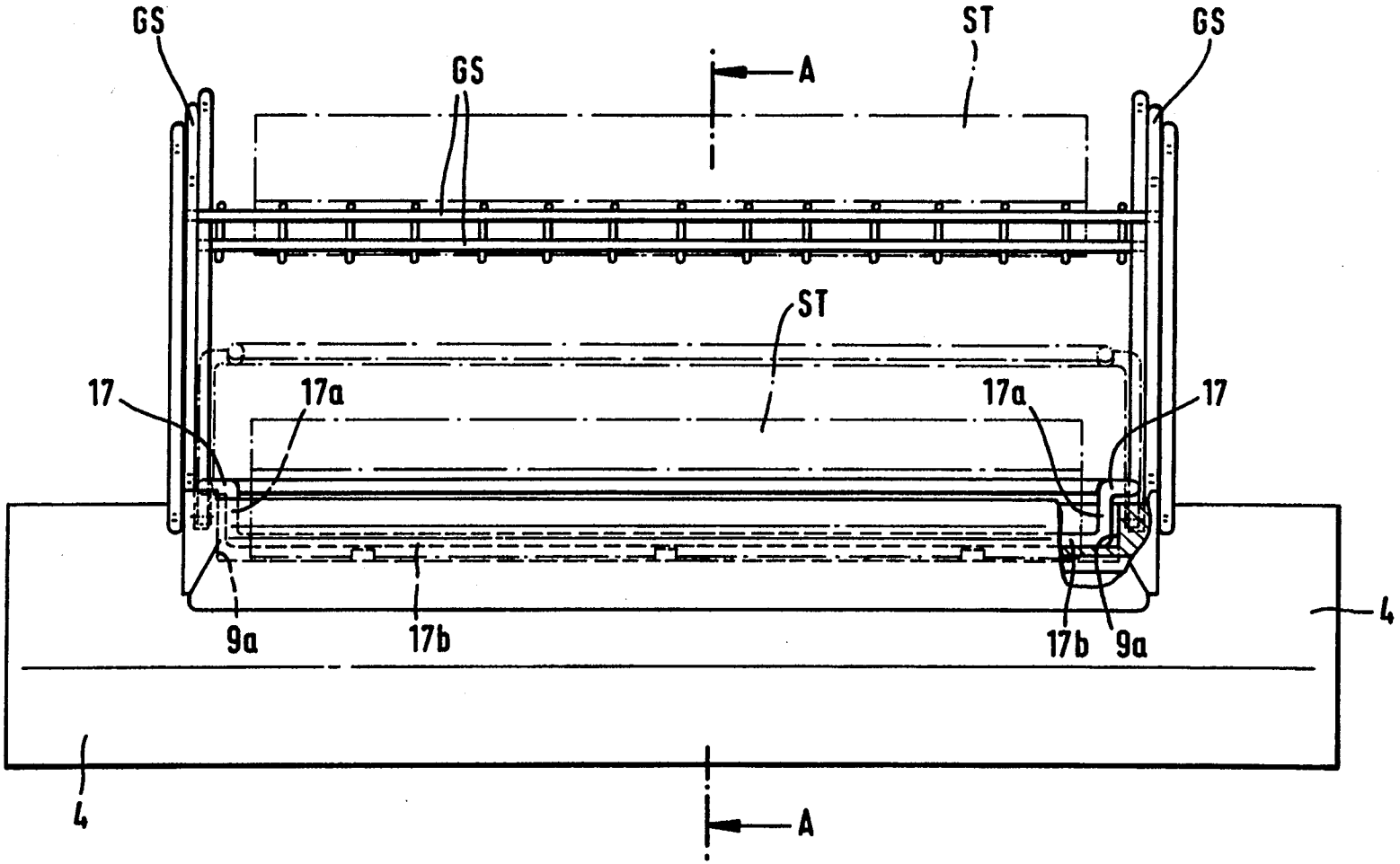
FIG. 7 is a front view of the paper shredder shown in FIG. 6.

An important structural feature is the fact that the paper-holding down device 17 has an angle portion 17*a* which is directed downwardly toward the ledge member 15 and which rests on top of the ledge member 15 directly behind the ledge-like paper stop 16. This creates a free space F between the respective paper stack ST and the angle portion 17*a*, so that the paper web PB can slide unimpededly through the free space F. The same is true when, as shown in FIGS. 6 and 7, several stacks ST are processed simultaneously, wherein the paper stacks ST are placed on a frame GS placed on top of the paper shredder.

Accordingly, the holding-down device 17, the angle portion 15*b* of the ledge member 15, the stop 16 and the lateral guide surfaces 9*a* interact directly with each other and ensure a problem-free insertion of folded continuous paper sizes as they are used in large quantities in computers.

Since the ledge member 6 or 15 is exchangeable, it is possible, in addition to the technical advantages of the configurations of the ledge member described above, to provide the ledge member with a different appearance from the hood 4 with respect to color, material and/or surface structure, for example, in so-called trend-influenced colors, and to change the appearance as desired, for example, in accordance with the architectural style used at the location of operation of the paper shredder.

Figure 3:
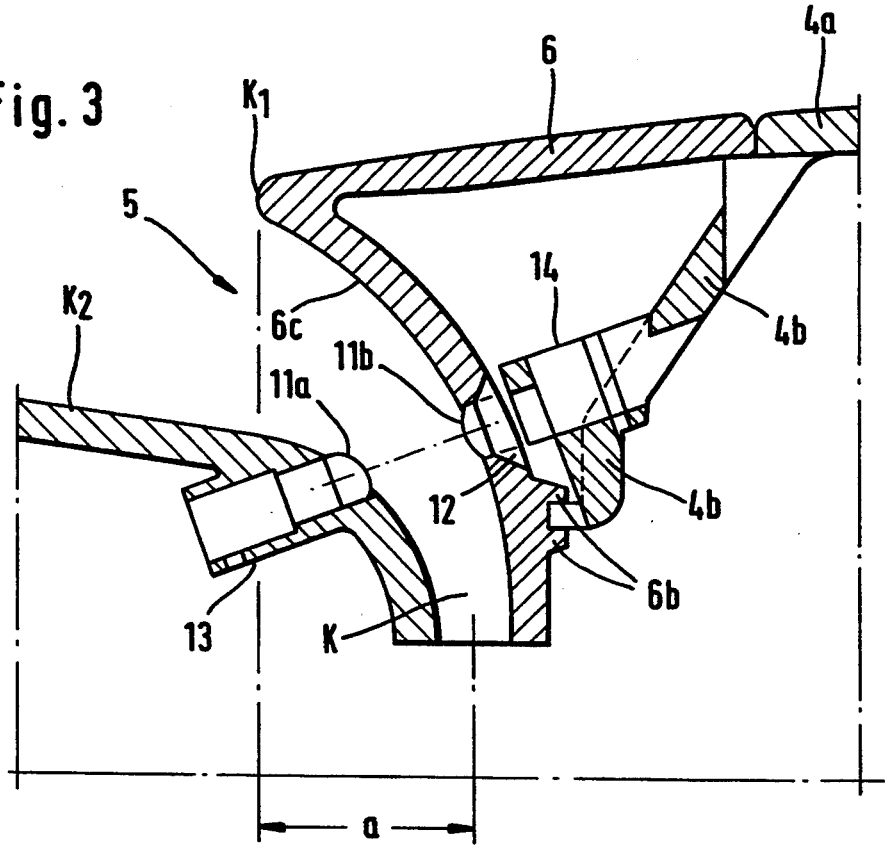
FIG. 3 is a sectional view similar to FIG. 2, showing another embodiment of the essential components of the paper shredder.

Finally, FIG. 3 shows the arrangement of a photoelectric cell 11*a*, 11*b* or of an appropriate sensor or the like, in the lower portion of the supply duct K near the cutting roller intake gap 3 for starting the cutting mechanism 1, 2 when material is inserted. As a result of the configuration of the supply duct, the photoelectric cell is effectively screened against light in bright sunny locations and, thus, unintentional starting of the cutting mechanism S as a result of strong or direct sun irradiation is prevented. In accordance with another specific feature, the elements of the photoelectric cell 11*a* and 11*b* are mounted in sleeves 13 and 14 provided in the supply duct K and the flange 4*b*, respectively, and the ledge member 6 is provided with a recess 12 in the region of the photoelectric 11*b*.

The invention is not limited by the embodiments described above which are presented as examples only but can be modified in various ways within the scope of protection defined by the appended patent claims.

I claim:

1. A paper shredder comprising a lower cabinet and an upper hood mounted on the cabinet, a cutting mechanism mounted in the cabinet, the cutting mechanism comprising cutting rollers defining an intake gap therebetween, the hood defining an essentially funnel-shaped supply duct for material to be cut, wherein the supply duct narrows toward the intake gap, the supply duct having an inlet opening and an upper side and a bottom side extending from the inlet opening, the inlet opening having an upper edge, the upper edge being located in vertical projection laterally offset relative to the intake gap such that the upper side of the supply duct overlaps the intake gap, the bottom side of the supply duct extending from the inlet opening initially along an essentially horizontally extending portion and from the horizontally extending portion curved downwardly essentially vertically toward the intake gap, a ledge member mounted on the hood as a separate component, the inlet opening and the upper edge of the supply duct being formed by the ledge member.

2. The paper shredder according to claim 1, wherein the hood has a recess corresponding in shape to the ledge member, the ledge member being replaceably mounted in the recess.

3. The paper shredder according to claim 2, wherein the ledge member comprises elements for clipping the ledge member to the hood, the hood having an upper surface, the ledge member extending flush with the upper surface.

4. The paper shredder according to claim 3, wherein the hood has an interior and a flange arranged in the interior, the ledge member having additional screws for securely connecting the ledge member to the flange.

5. The paper shredder according to claim 4, wherein the hood has a front portion and the upper free surface extends contiguous with the front portion, the upper surface being plane and extending inclined toward the inlet opening of the supply duct, the inlet opening being located adjacent the front portion of the hood, the ledge member having a front portion extending upwardly from the upper surface, the ledge member further having an angle portion with a lowermost point, the lowermost point forming a stop for material to be cut placed on the upper surface.

6. The paper shredder according to claim 5, wherein the ledge member has guide surfaces adapted to extend laterally of the material to be cut, the guide surfaces having contours extending to the upper edge of the supply duct.

7. The paper shredder according to claim 6, further comprising a stirrup-shaped paper holding-down device, the holding-down device having free ends, the free ends being connected to the guide surfaces, such that the holding-down device is substantially vertically pivotable.

8. The paper shredder according to claim 7, wherein the holding-down device comprises an angled portion directed downwardly toward the ledge member, the angled portion resting on a top of the ledge member immediately behind the stop.

9. The paper shredder according to claim 1, wherein the supply duct has a lower portion near the intake gap, a sensor for starting the cutting mechanism when material to be cut is inserted being mounted in the lower portion of the supply duct.

10. The paper shredder according to claim 9, wherein the sensor comprises photoelectric cells.

11. The paper shredder according to claim 10, wherein the supply duct and the flange each have a bushing, elements of the photoelectric cell being mounted in the bushings, and wherein the ledge member has a recess at the photoelectric cell.

12. A paper shredder comprising a lower cabinet and an upper hood mounted on the cabinet, a cutting mechanism mounted in the cabinet, the cutting mechanism comprising cutting rollers defining an intake gap therebetween, the hood defining an essentially funnel-shaped supply duct for material to be cut, wherein the supply duct narrows toward the intake gap, the supply duct having an inlet opening and an upper side and a bottom side extending from the inlet opening, the inlet opening having an upper edge, a ledge member mounted on the hood as a separate component, the inlet opening and the upper edge of the supply duct being formed by the ledge member, the hood having a front portion and an upper surface contiguous with the front portion, the upper surface being plane and extending inclined toward the inlet opening of the supply duct, the inlet opening being located adjacent the front portion of the hood, the ledge member having a front portion extending upwardly from the upper surface, the ledge member further having an angle portion with a lowermost point, the lowermost point forming a stop for material to be cut placed on the upper surface.

13. The paper shredder according to claim 12, wherein the ledge member has guide surfaces adapted to extend laterally of the material to be cut, the guide surfaces having contours extending to the upper edge of the supply duct.

14. The paper shredder according to claim 12, further comprising a stirrup-shaped paper holding-down device, the holding-down device having free ends, the free ends being connected to the guide surfaces, such that the holding-down device is substantially vertically pivotable.

* * * * *